US007903837B2

(12) United States Patent
Horigome

(10) Patent No.: US 7,903,837 B2
(45) Date of Patent: Mar. 8, 2011

(54) MAGNETIC CIRCUIT FOR SPEAKER DEVICE AND SPEAKER DEVICE

(75) Inventor: Minoru Horigome, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1218 days.

(21) Appl. No.: 11/515,890

(22) Filed: Sep. 6, 2006

(65) Prior Publication Data

US 2007/0058834 A1 Mar. 15, 2007

(30) Foreign Application Priority Data

Sep. 7, 2005 (JP) ..... 2005-259309

(51) Int. Cl.
*H04R 1/00* (2006.01)
*H04R 9/06* (2006.01)
*H04R 11/02* (2006.01)

(52) U.S. Cl. ..... 381/414; 381/412; 381/413; 381/420

(58) Field of Classification Search ..... 381/414
See application file for complete search history.

(56) References Cited

U.S. PATENT DOCUMENTS

| | | | | |
|---|---|---|---|---|
| 3,319,201 | A | 5/1967 | Coen | |
| 5,321,762 | A * | 6/1994 | Stuart | 381/420 |
| 6,738,490 | B2 * | 5/2004 | Brandt | 381/421 |

FOREIGN PATENT DOCUMENTS

| | | |
|---|---|---|
| DE | 3108715 | 6/1982 |
| JP | 56-128099 | 7/1981 |
| JP | 59-21199 | 2/1984 |
| JP | 60-22092 | 2/1985 |
| JP | 61-116500 | 6/1986 |
| JP | 04-048899 | 2/1992 |
| JP | 06-014393 | 1/1994 |
| JP | 06-054398 | 2/1994 |

* cited by examiner

*Primary Examiner* — Curtis Kuntz
*Assistant Examiner* — Matthew Eason
(74) *Attorney, Agent, or Firm* — Young & Thompson

(57) ABSTRACT

A magnetic circuit for a speaker device includes a yoke having a pole piece main body formed into a cylindrical shape or a hollow cylindrical column shape, and a flange part provided on an outer side thereof, a magnet arranged on the flange part, a plate arranged on the magnet, and an annular T-shape forming member arranged on the pole piece main body. A magnetic gap is formed between an inner peripheral wall of the plate and an outer peripheral wall of the T-shape forming member. A configuration formed by combining the T-shape forming member and the pole piece main body forms a T-shaped pole piece.

5 Claims, 7 Drawing Sheets

MAGNETIC CIRCUIT FOR SPEAKER DEVICE AND SPEAKER DEVICE

BACKGROUND OF THE INVENTION

1. Field of the Invention

The present invention relates to a configuration of a magnetic circuit for a speaker device.

2. Description of Related Art

Conventionally, there is known a speaker device including an external-magnet type magnet circuit having a yoke, a magnet and a plate, and a vibration system having a voice coil, a voice coil bobbin, a diaphragm, a cap and a frame. For example, in the speaker device, a magnetic circuit has a configuration as follows. The yoke has a pole piece formed into a cylindrical shape or a cylindrical column shape, and a flange part outwardly extending from a lower end portion of an outer peripheral wall of the pole piece. A ring-shaped magnet is arranged on the flange part, and a ring-shaped plate is arranged on the magnet. A magnetic gap is formed between the pole piece and the plate.

However, in the magnetic circuit having the configuration, since a thickness of the plate and a thickness (i.e., height) of the pole piece (also referred to as "center pole") in a direction of the thickness of the plate are different, a magnetic field lacking of concentration of a magnetic flux is formed in the vicinity of a lower side of the magnetic gap. Thereby, the magnetic field formed on an upper side of the magnetic gap and the magnetic field formed on the lower side of the magnetic gap are set to be asymmetrical in an up-and-down direction with respect to a center line passing through a center in a direction of the thickness of the plate. By occurrence of the asymmetrical magnetic field, the voice coil, the voice coil bobbin and the diaphragm cannot be moved in the axis direction of the speaker device. Then, it becomes problematic that secondary harmonic distortion occurs and sound quality is deteriorated.

As a magnetic circuit for solving the problem, there is proposed a magnetic circuit for a speaker device having a T-shaped pole piece (see Japanese Utility model Application Laid-open under No. 60-22092 and Japanese Patent Application Laid-open under No. 56-128099, for example). In the magnetic circuit, the thickness of the plate and the thickness of the upper end part of the pole piece forming a T-shaped part are formed substantially same. Thereby, the magnetic field formed on the upper side of the magnetic gap and the magnetic field formed on the lower side thereof are set to be symmetrical in the up-and-down direction, which solves the above problem. In addition, an example of the magnetic circuit having the shape similar to the T-shaped pole piece is disclosed in Japanese Patent Applications Laid-open under No. 6-14393 and No. 6-54398.

There is known a magnetic circuit for a speaker device formed by providing an alloy magnet at an upper part of a pole piece in a yoke and arranging a resin magnet layer on a surface of the alloy magnet (see Japanese Patent Application Laid-open under No. 4-48899, for example). By this configuration, a magnetic circuit having a magnetic gap formed with high accuracy and high magnetic energy can be obtained.

The above-mentioned T-shaped pole piece is integrally formed by a cutting work of a work. However, many parts of the work have tone cut in order to form the T-shaped pole piece. Thereby, it becomes problematical that a manufacturing cost of the T-shaped pole piece increases and thereby a manufacturing cost of the magnetic circuit also increases. As a result, the magnetic circuit of the above-mentioned type is generally applied to a luxury model speaker device at high price.

SUMMARY OF THE INVENTION

The present invention has been achieved in order to solve the above problems. It is an object of this invention to provide a magnetic circuit for a speaker device and a speaker device including the magnetic circuit, capable of easily configuring a T-shaped pole piece at low price.

According to one aspect of the present invention, there is provided a magnetic circuit for a speaker device including a pole piece and a magnetic gap, wherein the pole piece includes a pole piece main body formed into a hollow column shape or a column shape, and a T-shape forming member arranged at a position corresponding to the magnetic gap and having an outer diameter larger than the pole piece main body.

The above magnetic circuit for the speaker device has the pole piece and the magnetic gap. The pole piece includes the pole piece main body formed into the hollow column shape or the column shape and the T-shape forming member arranged at the position corresponding to the magnetic gap and having the outer diameter larger than the pole piece main body. In a preferred example, the pole piece main body may be formed into a cylindrical shape or a cylindrical column shape, and the T-shape forming member may be formed into an annular shape, a disc shape or a cover shape. In addition, the T-shape forming member and the pole piece main body are preferably made of a metal material such as iron. Moreover, the T-shape forming member may be mounted on an upper surface of the pole piece main body. When the T-shape forming member has the cover shape, the T-shape forming member is preferably mounted on the upper surface of the pole piece main body so as to cover the side of the upper end part of the pole piece main body.

Thereby, the pole piece forms a configuration having the T-shaped or T-style cross-sectional shape. Therefore, the magnetic field formed in the vicinity of the upper side of the magnetic gap and the magnetic field formed in the vicinity of the lower side of the magnetic gap are set to be symmetrical with respect to the center line passing through the center in the direction of the thickness of the T-shape forming member. Thus, in the speaker device to which the magnetic circuit for the speaker device is applied, at the time of the driving, the voice coil, the voice coil bobbin and the diaphragm can be moved to the direction of the central axis of the speaker device. Thereby, occurrence of secondary harmonic distortion can be reduced, and deterioration of sound quality can be prevented.

Particularly, in the magnetic circuit for the speaker device, the pole piece includes two parts, i.e., the pole piece main body and the T-shape forming member. By combining them, the T-shaped pole piece is formed. Therefore, in a manufacturing process of the magnetic circuit for the speaker device, it becomes possible that the pole piece main body and the T-shape forming member are formed by a cold forging technique or a press forming technique, not by a cutting work technique. Namely, in the manufacturing process of the magnetic circuit for the speaker device, the T-shaped pole piece can be formed without using the cutting work technique. Thereby, as compared with a case that the T-shaped pole piece is integrally formed by using the cutting work technique, the T-shaped pole piece can be easily manufactured at low price, and thereby a manufacture cost of the magnetic circuit for the speaker device can be reduced. As a result, the magnetic circuit for the speaker device can be applied not only to the luxury model speaker device at high price but also to a general purpose speaker device at a popular price.

In a manner, the magnetic circuit for the speaker device may further include a flange part provided on an outer side of the pole piece main body and a magnet arranged on the flange part and a plate arranged on the magnet, wherein the plate is arranged at a position corresponding to the T-shape forming member.

In this manner, the above magnetic circuit for the speaker device further has the flange part provided on the outer side of the pole piece main body, the magnet positioned on the flange part, and the plate positioned on the magnet. Thereby, the magnetic flux of the magnet can be concentrated on the magnetic gap. Additionally, since the plate is arranged at the position corresponding to the T-shape forming member, the plate and the T-shape forming member, sandwiching the magnetic gap, are opposite to each other. Thereby, the magnetic field formed in the vicinity of the upper side of the magnetic gap and the magnetic gap formed in the vicinity of the lower end of the magnetic gap are set to be symmetrical with respect to the center line passing through the center in the direction of the thickness of the T-shape forming member. Thereby, characteristic operation and effect of the magnetic circuit having the so-called T-shaped pole piece can be obtained.

In another manner, the T-shape forming member may have an annular part formed into an annular shape, and a cylindrical part projecting from one surface of an outer peripheral portion of the annular part and having a cylindrical shape. In addition, an internal diameter of the cylindrical part may be formed slightly larger than an outer diameter of the pole piece main body, and the cylindrical part may engage with an upper end part of the pole piece main body. Moreover, the T-shape forming member may be formed thicker than a thickness of the plate, and a distance from a center line passing through a center in a direction of the thickness of the plate to an upper surface of the pole piece main body and a distance from the center line to a lower surface of the pole piece main body may be set to a substantially same value. Thereby, the magnetic field formed in the vicinity of the upper side of the magnetic gap and the magnetic field formed in the vicinity of the lower side of the magnetic gap are set to be symmetrical with respect to the center line passing through the center in the direction of the thickness of the T-shaped forming member. Thereby, the characteristic operation and effect of the magnetic circuit having the so-called T-shaped pole piece can be obtained.

In addition, a speaker device including the above magnetic circuit for the speaker device can be formed. Thereby, the magnetic circuit for the speaker device having the T-shaped pole piece can be applied to the general purpose speaker device at the normal price.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings.

First Embodiment

Configuration of Speaker Device

Figure 1:
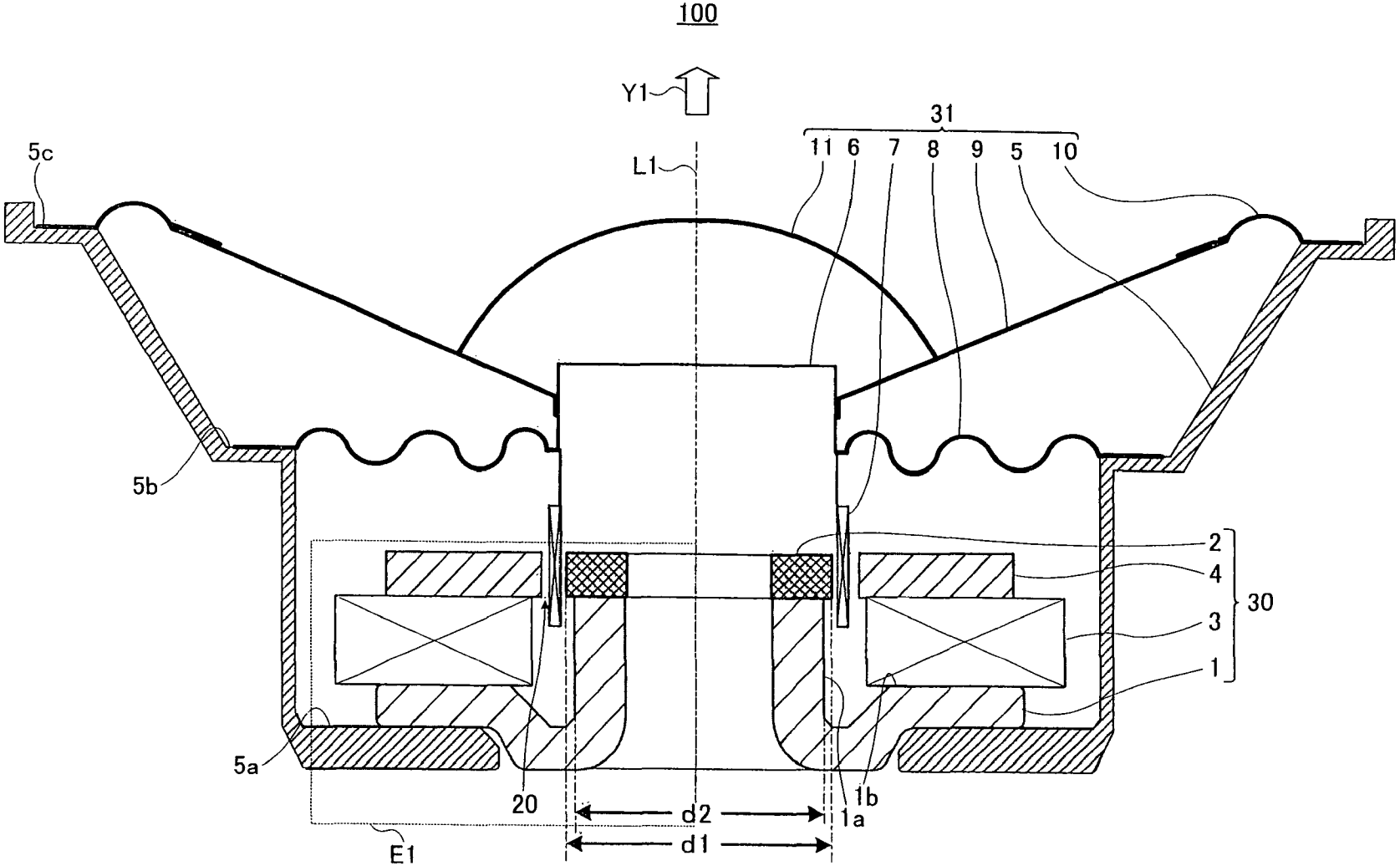
FIG. 1 shows a cross-sectional view of a speaker device according to a first embodiment of the present invention.

FIG. 1 shows a cross-sectional view of a speaker device 100 including the magnetic circuit according to a first embodiment of the present invention, taken along a plane including a central axis L1 thereof.

As shown in FIG. 1, the speaker device 100 mainly includes a magnetic circuit 30 including a yoke 1, a T-shape forming member 2, a magnet 3 and a plate 4, and a vibration system 31 including a frame 5, a voice coil bobbin 6, a voice coil 7, a damper 8, a diaphragm 9, an edge 10 and a cap 11. In this invention, the configuration of the speaker device and a driving system thereof are not particularly limited.

First, a description will be given of the configuration of the magnetic circuit 30. The magnetic circuit 30 is configured as an external-magnet type magnetic circuit.

The yoke 1, which has a cross-sectional shape of a reversed T-shape, has a pole piece main body 1*a* and a flange part 1*b* outwardly extending from a lower end portion of an outer peripheral wall of the pole piece main body 1*a*. The pole piece main body 1*a* is formed into a hollow column shape, and in a preferred example, it is formed into a cylindrical shape or a hollow cylindrical column shape. The pole piece main body 1*a* is preferably formed by a metal material such as iron.

The T-shape forming member 2 formed into an annular (ring) shape is mounted on the pole piece main body 1*a*. The T-shape forming member 2 is preferably made of a metal material such as iron. The detailed configuration of the T-shape forming member 2 will be described later.

The magnet 3 formed into an annular shape is mounted on the flange part 1*b* of the yoke 1. The plate 4 formed into an annular shape is mounted on the magnet 3. Thereby, the plate 4 is arranged at a position corresponding to the T-shape forming member 2.

In the magnetic circuit 30 having the above-mentioned configuration, a magnetic gap 20 is formed between an inner peripheral wall of the plate 4 and an outer peripheral wall of the T-shape forming member 2.

Next, a description will be given of the configuration of the vibration system 31.

The frame 5 formed into a substantial cup shape has a function to support components of the speaker device 100. The frame 5 having a step cross-sectional shape has a first step part 5*a*, a second step part 5*b* provided on an upper and outer side of the first step part 5*a*, and a third step part 5*c* provided on an upper and outer side of the second step part 5*b*. On the first step part 5*a* of the frame 5, the flange part 1*b* of the yoke 1 is mounted. The frame 5 supports the magnetic circuit 30.

The voice coil bobbin 6 is formed into a substantially cylindrical shape. A lower end portion of the voice coil bobbin 6 is arranged at a position covering the T-shape forming member 2. Therefore, the vicinity of the lower end portion of the inner peripheral wall of the voice coil bobbin 6 is opposite to an outer peripheral wall of the T-shape forming member 2. Meanwhile, the vicinity of the lower end portion of the outer peripheral wall of the voice coil bobbin 6 is opposite to the inner peripheral wall of the plate 4.

The voice coil 7 includes one wiring, which includes a plus lead wire and a minus lead wire. The plus lead wire is an input wiring for an L (or R)-channel signal, and the minus lead wire is an input wiring for a ground (GND:ground) signal. The voice coil 7 is wound around the vicinity of the lower end portion of the outer peripheral wall of the voice coil bobbin 6. The plus and minus lead wires of the voice coil 7 are connected to terminals (not shown) provided at an appropriate position of the frame 5. In addition, the terminals are also connected to output wirings of an amplifier (not shown). Thereby, the signal and the power of one channel are inputted to the voice coil 7 from the amplifier side via the terminals and the plus and minus lead wires.

The damper 8 formed into a substantially annular shape has a wave-shaped elastic part elastically supporting the voice coil bobbin 6. An inner peripheral edge portion of the damper 8 is mounted on the vicinity of the upper end portion of the outer peripheral wall of the voice coil bobbin 6. Meanwhile, an outer peripheral edge portion of the damper 8 is mounted on the second step part 5*b* of the frame 5.

The diaphragm 9 has a function to radiate an acoustic wave corresponding to an input signal. An inner peripheral edge portion of the diaphragm 9 is mounted on the upper side of the damper 8 and on the upper end portion of the outer peripheral wall of the voice coil bobbin 6.

The edge 10 has a substantially Ω-shaped cross-sectional shape. An inner peripheral edge portion of the edge 10 is mounted on the outer peripheral edge portion of the diaphragm 9, and an outer peripheral edge portion of the edge 10 is mounted on the third step part 5*c* of the frame 5. In this embodiment, the diaphragm 9 and the edge 10 are separately formed. However, this is not limited in the present invention. Namely, the diaphragm 9 and the edge 10 may be integrally formed.

The cap 11 is formed into a substantially semi-sphere shape. A circumferential end portion of the cap 11 is mounted on a surface on the sound output side of the diaphragm 9 in the vicinity of the inner peripheral portion thereof. Thereby, the cap 11 mainly has a function to prevent water and a foreign material from entering the magnetic circuit 30.

In the speaker device 100 having the above-mentioned configuration, the signal and power outputted from the amplifier are supplied to the voice coil 7 via the terminals and each of the plus and minus lead wires of the voice coil 7. Thereby, driving force occurs to the voice coil 7 in the magnetic gap 20, which vibrates the diaphragm 9 in the direction of the central axis L1 of the speaker device 100. In this manner, the speaker device 100 radiates the acoustic wave in the direction of an arrow Y1.

(Configuration of Magnetic Circuit)

Next, a description will be given of the configuration of the magnetic circuit 30 having the pole piece according to the first embodiment of the present invention, with reference to FIG. 2 and FIG. 3.

Figure 2:
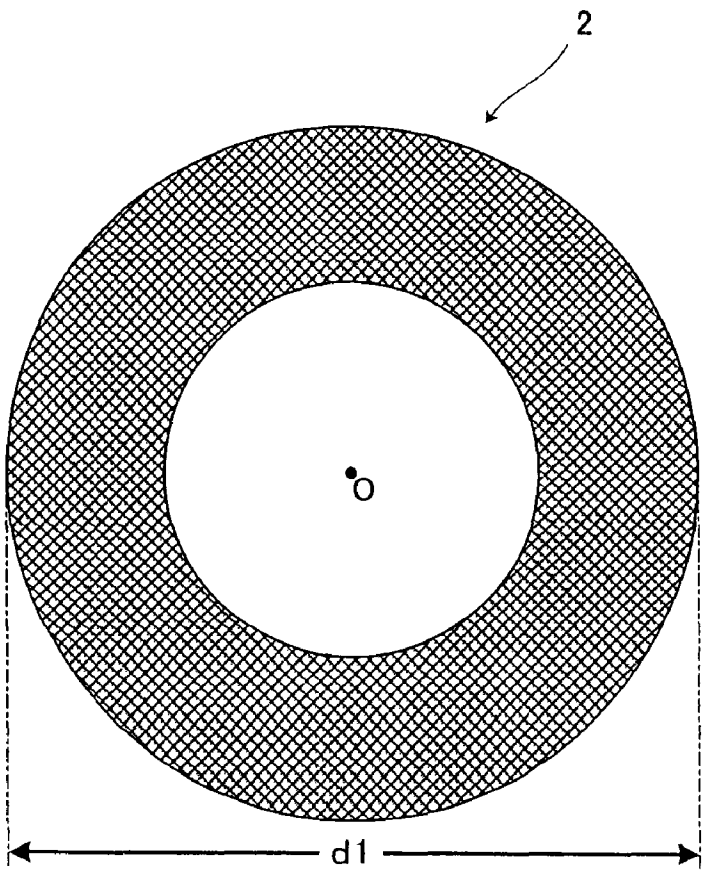
FIG. 2 shows a plane view of a T-shape forming member according to the first embodiment.

FIG. 2 shows a plane view of the T-shape forming member 2 when observed from a direction opposite to the direction of the arrow Y1 shown in FIG. 1. FIG. 3 shows a cross-sectional view of the vicinity of an enlarged broken-line area E1 shown in FIG. 1. In FIG. 3, for convenience of explanation, illustrations of the voice coil bobbin 6 and the voice coil 7 are omitted.

The T-shape forming member 2 is formed into an annular (ring) shape, and an outer diameter of the T-shape forming member 2 is set to d1. The T-shape forming member 2 is mounted on the pole piece main body 1*a* having an outer diameter d2 (<d1). Therefore, as shown in FIG. 1 and FIG. 3, a configuration (hereinafter referred to as "T-shaped pole piece") obtained by combining the T-shape forming member 2 and the pole piece main body 1*a* has a cross-sectional shape of T-shaped or T-type. Namely, the T-shape forming member 2 is mounted on the pole piece main body 1*a*, which forms the configuration (T-shaped pole piece) having the cross-sectional shape of T-shaped or T-type with the pole piece main body 1*a*. The T-shape forming member 2 is arranged at a position corresponding to the plate 4, and an upper surface of the T-shape forming member 2 and an upper surface of the plate 4 substantially become flush with each other. In addition, in the first embodiment, a thickness of the T-shape forming member 2 is set to d4 substantially same as a thickness of the plate 4. However, in the present invention, it is unnecessary that both the thicknesses are same. In the magnetic circuit 30, a magnetic field 50 having plural magnetic fluxes 50*a* (broken-line parts) is formed in the magnetic gap 20 formed between the outer peripheral wall of the T-shape forming member 2 and the inner peripheral wall of the plate 4.

In this magnetic circuit 30, the T-shape forming member 2 is arranged at the position corresponding to the plate 4. By the configuration, in the magnetic circuit 30, the same operation and effect as the magnetic circuit having the so-called T-shaped pole piece can be obtained. Namely, in the magnetic circuit 30, it becomes possible that the magnetic field formed in an area E2 on the upper side of the magnetic gap 20 and the magnetic field formed in an area E3 on the lower side of the magnetic gap 20 are set to be symmetrical with respect to a center line L2 passing through a center in the direction of the thickness of the T-shape forming member 2. Therefore, in the speaker device 100, at the time of the driving, the voice coil 7, the voice coil bobbin 6 and the diaphragm 9 can be moved in the direction of the central axis L1 of the speaker device 100. Thereby, in the speaker device 100, the occurrence of the secondary harmonic distortion can be reduced, and deterioration of sound quality can be prevented.

Next, a description will be given of operation and effect of the speaker device 100 having the magnetic circuit 30.

As described above, the T-shaped pole piece generally known is integrally formed by a cutting work of a work (hereinafter referred to as "a comparative example"). However, many parts of the work have to be cut in order to form the T-shaped pole piece. Therefore, it is problematic that a manufacturing cost of the T-shaped pole piece increases and thus a manufacturing cost of the magnetic circuit also increases. As a result, the magnetic circuit is generally applied to a luxury model speaker device at high price.

Meanwhile, in the first embodiment of the present invention, two parts, i.e., the pole piece main body 1*a* formed into the cylindrical shape or the hollow cylindrical column shape and the T-shape forming member 2 formed into the annular (ring) shape, are provided. Then, by combining them, the T-shaped pole piece is formed.

Therefore, in the manufacturing process of the magnetic circuit 30, the pole piece main body 1*a* being the component of the yoke 1 and the T-shape forming member 2 can be formed by executing a cold forging operation technique or a press forming technique, not by executing the cutting work technique. Namely, in the first embodiment, the T-shaped pole piece can be basically formed without using the cutting work technique. At the time of combining of the pole piece main body 1*a* and the T-shape forming member 2, the cutting work can be executed to an appropriate part of the pole piece thus combined and formed. In this case, however, the part to which the cutting work is executed is smaller than that of the comparative example. Thereby, as compared with the comparative example, the T-shaped pole piece can be easily manufactured at a low price, which can reduce the manufacturing cost of the magnetic circuit 30. As a result, the magnetic circuit 30 can be applied not only to the luxury model speaker device at high price but also to a general-purpose model speaker device at a popular price.

Second Embodiment

Next, a description will be given of the configuration of the magnetic circuit 30 having the pole piece according to a second embodiment of the present invention, with reference to FIG. 4.

Figure 4:
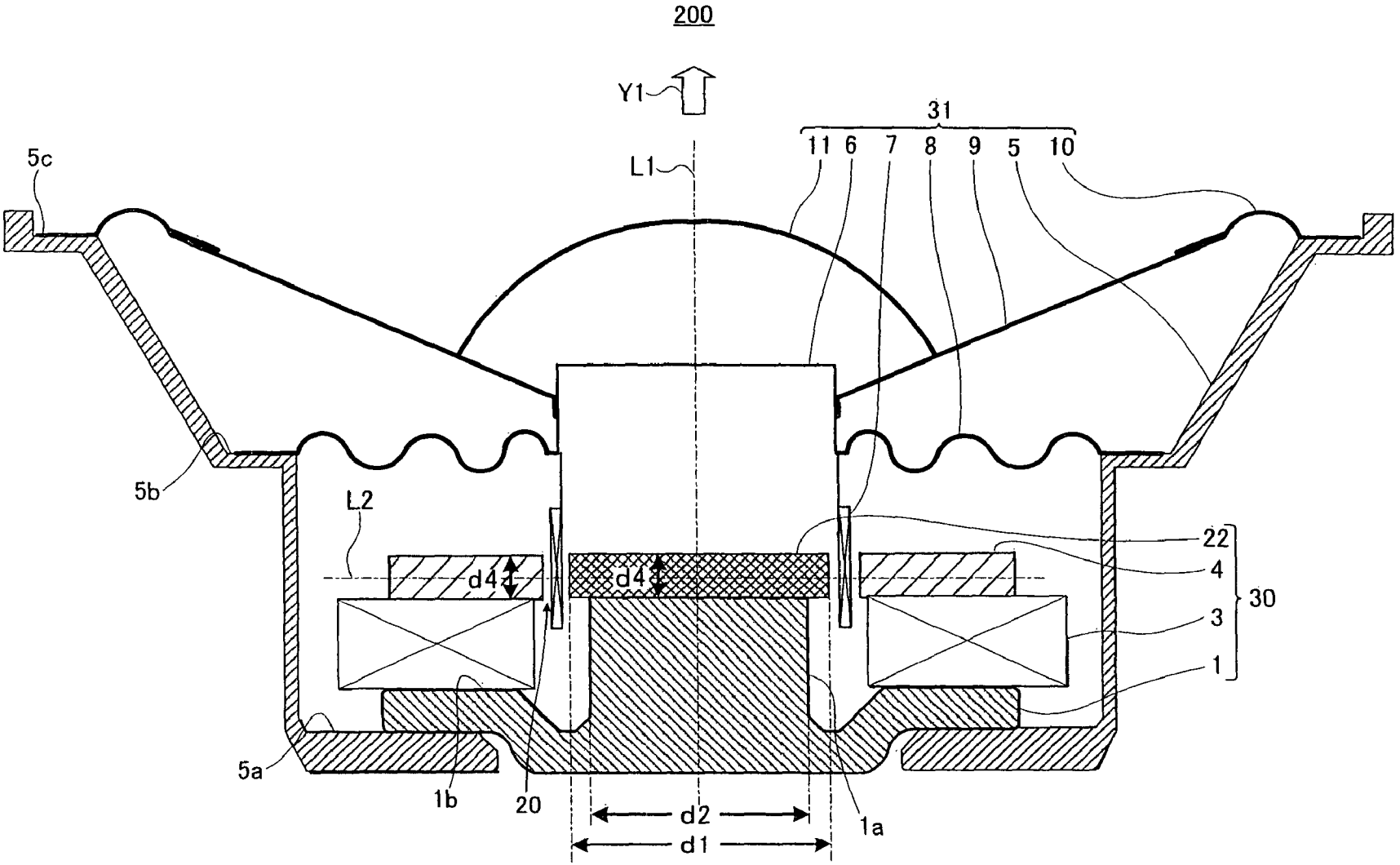
FIG. 4 shows a cross-sectional view of the speaker device according to a second embodiment of the present invention.

FIG. 4 is a cross-sectional view showing a configuration of a speaker device 200 according to the second embodiment, in correspondence to FIG. 1. The same reference numerals are given to the same components as those of the first embodiment, and explanations thereof are omitted or simplified.

As understood by comparing the second embodiment with the first embodiment, in the second embodiment, only the shapes of the pole piece main body 1*a* being the component of the yoke 1 and the T-shape forming member are different from those of the first embodiment.

Namely, in the first embodiment, the pole piece main body 1*a* is formed into the cylindrical shape or the hollow cylindrical column shape. Meanwhile, in the second embodiment, the pole piece main body 1*a* is formed into a column shape, preferably formed into a cylindrical column shape. In addition, in the first embodiment, the T-shape forming member 2 is formed into the annular (ring) shape. Meanwhile, in the second embodiment, a T-shape forming member 22 is formed into a disc shape. Though there are such differences between the first embodiment and the second embodiment, the T-shaped or T-style pole piece of the second embodiment, having the T-shape forming member 22 and the pole piece main body 1*a*, is formed into the T-shaped cross-sectional shape, similarly to the T-shaped pole piece of the first embodiment. Additionally, in the second embodiment, a thickness of the T-shape forming member 22 is set to d4 substantially same as the thickness of the plate 4. However, in this invention, it is unnecessary that those thicknesses are the same. Hence, in the second embodiment, the magnetic field formed in the vicinity of the upper side of the magnetic gap 20 and the magnetic field formed in the vicinity of the lower side of the magnetic gap 20 are set to be symmetrical with respect to the central line L2 passing through the center in the direction of the thickness of the T-shape forming member 22. Further, in the second embodiment, two parts, i.e., the pole piece main body 1*a* formed into the cylindrical column shape and the T-shape forming member 22 formed into the disc shape, are provided. Then, by combining them, the T-shaped pole piece is formed. By the above configuration, in the second embodiment, the same operation and effect as those of the first embodiment can be obtained.

Third Embodiment

Next, a description will be given of the configuration of the magnetic circuit 30 including the pole piece according to a third embodiment of the present invention, with reference to FIG. 5 and FIG. 6. Hereinafter, the same reference numerals are given to the same components as those of the first embodiment, and explanations thereof are omitted or simplified.

Figure 5:
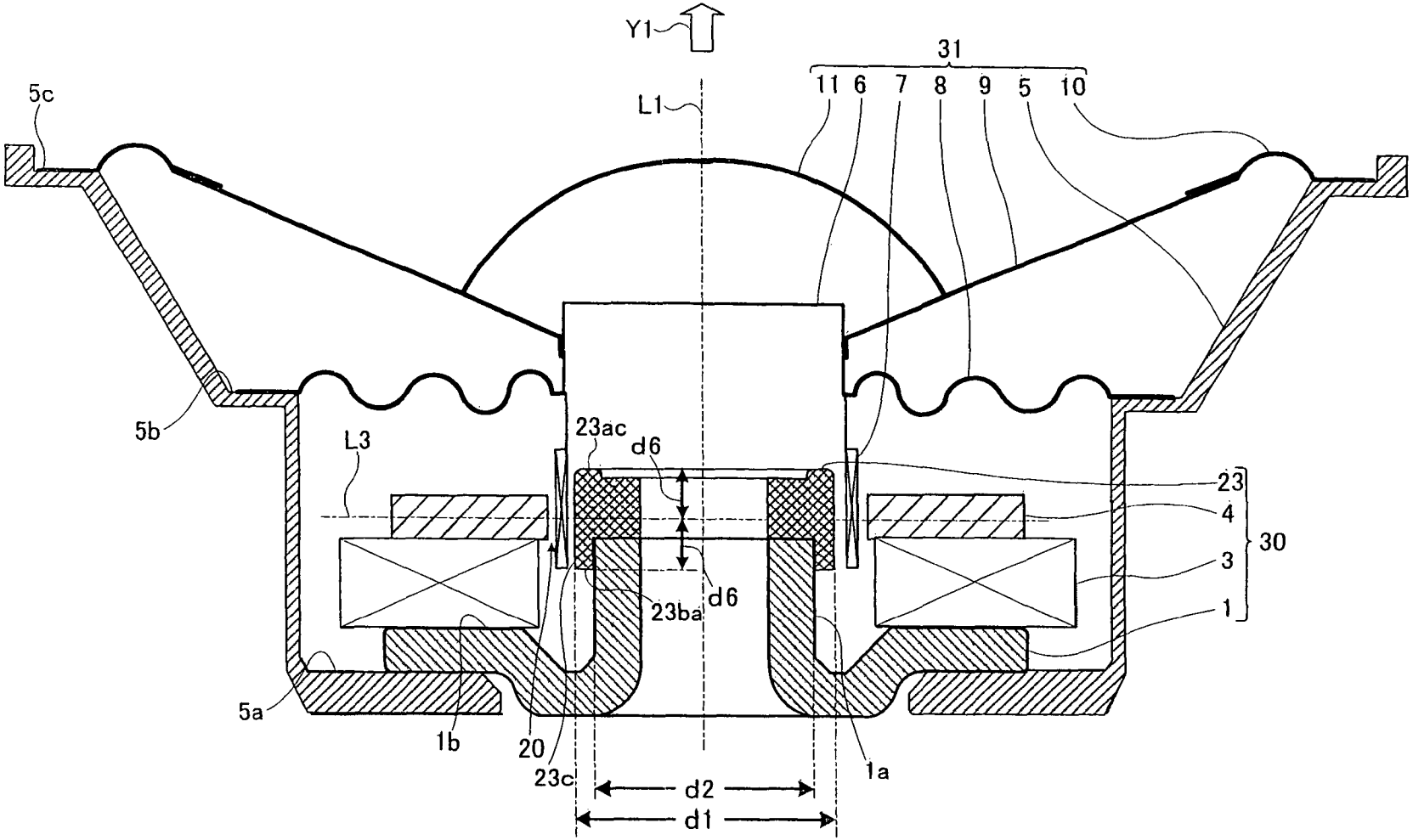
FIG. 5 shows a cross-sectional view of the speaker device according to a third embodiment of the present invention.
Figure 6:
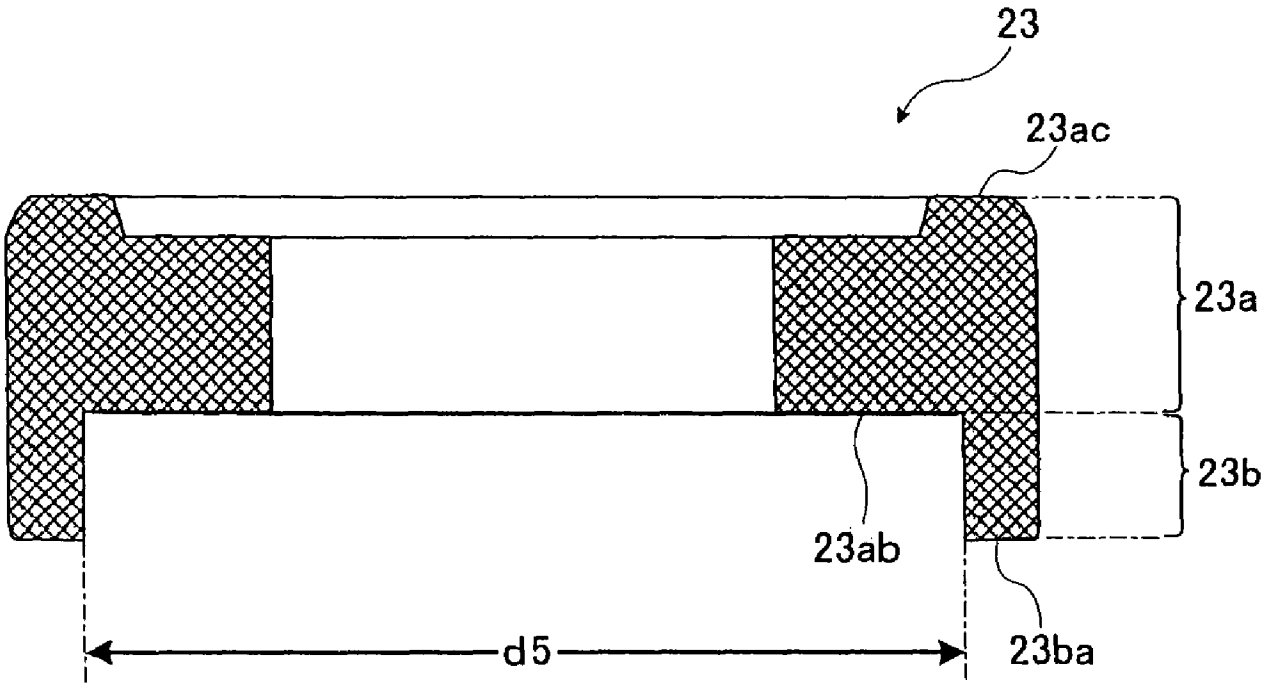
FIG. 6 shows an enlarged cross-sectional view of the T-shape forming member according to the third embodiment.

FIG. 5 is a cross-sectional view showing a configuration of a speaker device 300 according to the third embodiment, in correspondence with FIG. 1. FIG. 6 is an enlarged cross-sectional view of T-shape forming member 23 according to the third embodiment, shown in FIG. 5.

As understood by comparing the third embodiment with the first embodiment, in the third embodiment, only the shape of the T-shape forming member is different from that of the first embodiment.

Namely, the T-shape forming member 23 of the third embodiment basically has a substantially annular (substantially ring) shape, like the T-shape forming member 2 of the first embodiment. However, the T-shape forming member 23 of the third embodiment further has a cylindrical part formed into a cylindrical shape, which is different from the T-shape forming member 2 of the first embodiment. Concretely, as shown in FIG. 6, the T-shape forming member 23 of the third embodiment has an annular part 23*a* formed into a substantially annular (substantially ring) shape, and a cylindrical part 23*b* projecting from one surface (lower surface) 23*ab* of an outer peripheral portion of the annular part 23*a* and formed into a cylindrical shape. An internal diameter of the cylindrical part 23*b* is set to a value d5 slightly larger than the outer diameter d2 of the pole piece main body 1*a*, and the cylindrical part 23*b* engages with the upper end portion of the pole piece main body 1*a*, as shown in FIG. 5. Though there is such a configuration difference between the first embodiment and the third embodiment, the T-shaped pole piece of the third embodiment, having the T-shape forming member 23 and the pole piece main body 1*a*, is formed into a T-shaped or T-style cross-sectional shape, similarly to the T-shaped pole piece of the first embodiment.

In addition, in FIG. 5, a distance from a center line L3 passing through the center in the direction of the thickness of the plate 4 to an upper surface 23*ac* of the T-shape forming member 23 is set to d6 being a substantially same value as a distance from the center line L3 to a lower surface 23*ba* of the T-shape forming member 23. Therefore, in the third embodiment, the magnetic field formed in the vicinity of the upper side of the magnetic gap 20 and the magnetic field formed in the vicinity of the lower side of the magnetic gap 20 are formed to be symmetrical with respect to the center line L3 passing through the center in the direction of the thickness of the plate 4. In addition, in the third embodiment, two parts, i.e., the pole piece main body 1*a* formed into the cylindrical shape or the hollow cylindrical column shape and the T-shape forming member 23 having a shape similar to an annular shape, are particularly provided. By combining them, the T-shaped pole piece is formed. By the above-mentioned configuration, in the third embodiment, the same operation and effect as those of the first embodiment can be obtained.

Fourth Embodiment

Next, a description will be given of the configuration of the magnetic circuit 30 including the pole piece according to a fourth embodiment of the present invention, with reference to FIG. 7. Hereinafter, the same reference numerals are given to the same components of the first embodiment, and explanations thereof are omitted or simplified.

Figure 3:
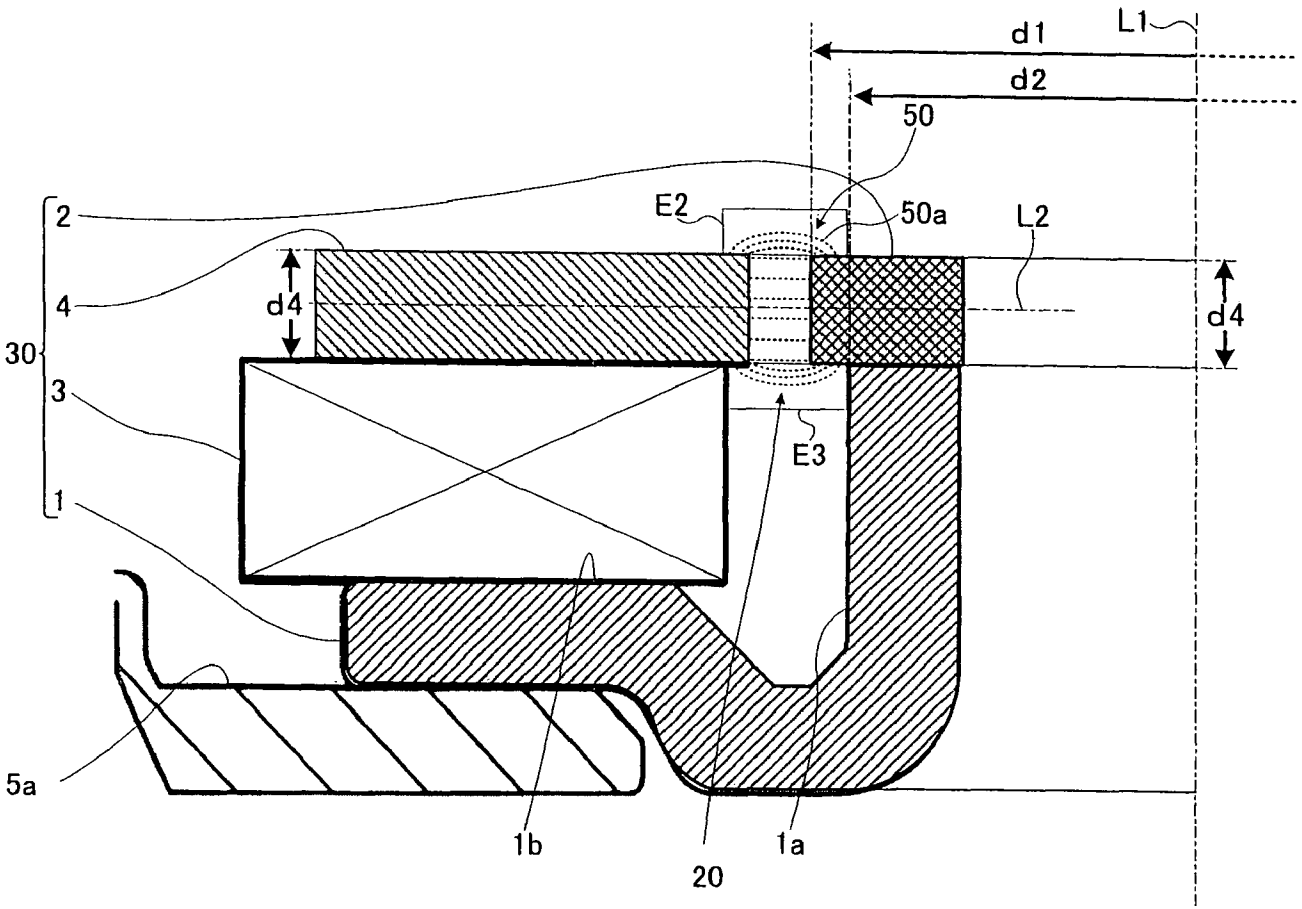
FIG. 3 is a cross-sectional view of the enlarged vicinity of the T-shape forming member according to the first embodiment.
Figure 7:
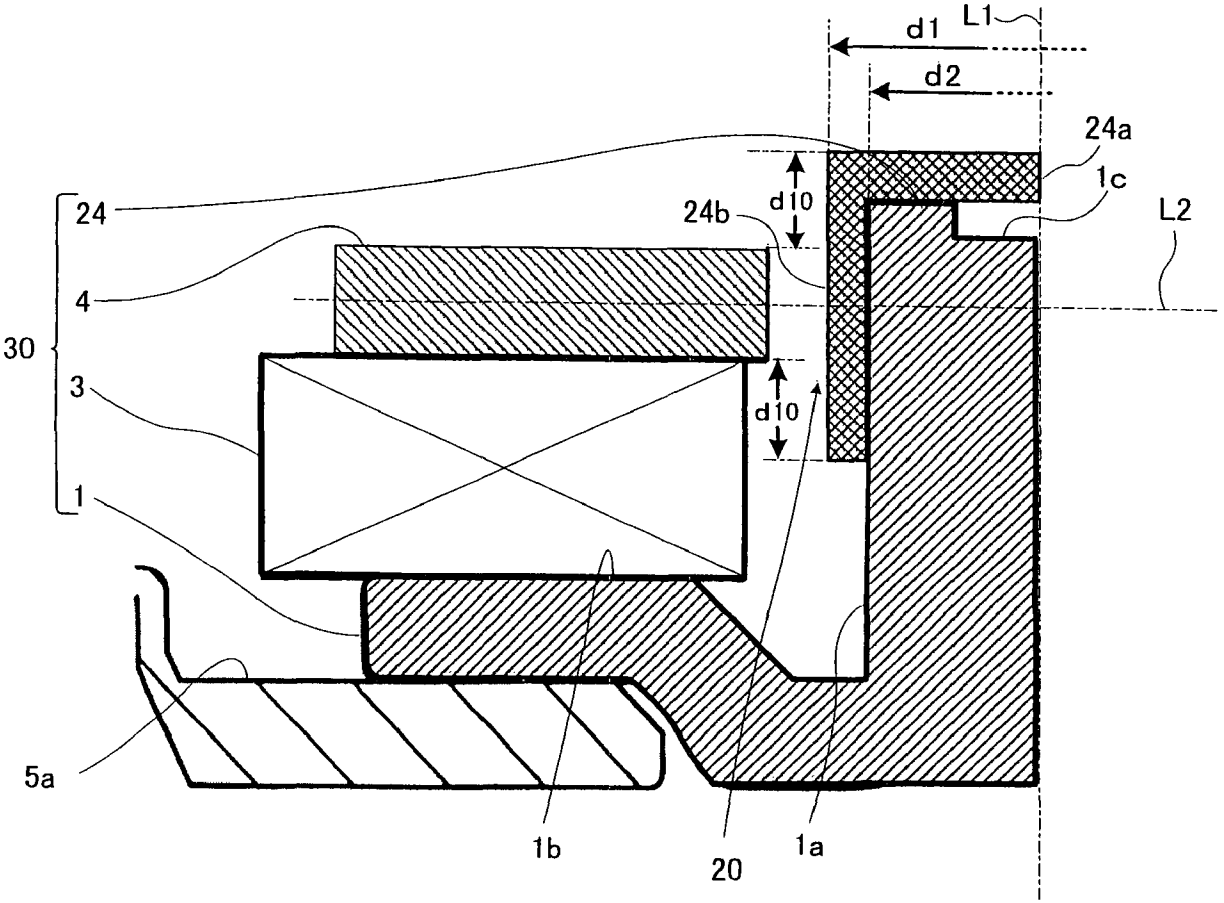
FIG. 7 is a cross-sectional view of the enlarged vicinity of the T-shape forming member according to a fourth embodiment.

FIG. 7, corresponding to FIG. 3, is a cross-sectional view showing the configuration in the vicinity of the magnetic circuit 30 of the speaker device according to the fourth embodiment.

As understood by comparing the first embodiment and the fourth embodiment, in the fourth embodiment, shapes of the pole piece main body 1*a* and a T-shape forming member 24 being the components of the magnetic circuit 30 are different from those of the first embodiment.

Namely, in the first embodiment, the pole piece main body 1*a* has the cylindrical shape or the hollow cylindrical column shape. Meanwhile, in the fourth embodiment, the pole piece main body 1*a* is formed into a substantially cylindrical column shape. In addition, on the upper surface of the pole piece main body 1*a* according to the fourth embodiment, a recessed part 1*c* is formed. Additionally, though the T-shape forming member 2 has the annular (ring) shape in the first embodiment, the T-shape forming member 24 has a shape like a cover or a lid in the fourth embodiment. Concretely, the T-shape forming member 24 has a disc part 24*a* formed into a disc shape, and a cylindrical part 24*b* projecting from one surface of an outer peripheral portion of the disc part 24*a* and formed into a cylindrical shape. It is preferable that the T-shape forming member 24 is formed by executing the press forming of a cold rolling steel plate (SPCC) having a thickness of substantially 3 mm. In addition, an internal diameter of the T-shape forming member 24 is set slightly larger than the outer diameter of the pole piece main body 1*a*, and an outer diameter of the T-shape forming member 24 is set to d1 (>d2). The T-shape forming member 24 engages with the upper end part of the pole piece main body 1*a* in order to cover it. In such a state, a distance (distance in the direction of the central axis L1) from the upper surface of the T-shape forming member 24 to the upper surface of the plate 4 is set to d10, and a distance (distance in the direction of the central axis L1) from the lower surface of the T-shape forming member 24 to the lower surface of the plate 4 is also set to d10. Thereby, the magnetic field (not shown) formed in the area in the vicinity of the upper side of the magnetic gap 20 and the magnetic field formed in the area in the vicinity of the lower side of the magnetic gap 20 can be symmetrical with respect to the center line L2 passing through the center in the direction of the thickness of the plate 4.

In the fourth embodiment having the above-mentioned configuration, two parts, i.e., the pole piece main body 1*a* formed into the substantially cylindrical column shape and the T-shape forming member 24 formed into the cover shape, are provided. By combining them, the T-shaped pole piece is formed. Thereby, in the fourth embodiment, the same operation and effect as those of the first embodiment can be obtained.

Now, it is prescribed that the T-shape forming member 24 according to the fourth embodiment, manufactured by executing the press forming technique, the above-mentioned T-shape forming member 23 according to the third embodiment, manufactured by executing the cold forging operation technique, and the T-shape forming member, manufactured by executing only the cutting work, are referred to as "Manufacture-1", "Manufacture-2" and "Manufacture-3", respectively. When they are compared in view of manufacturing costs, there is a relation as follows. Manufacture-1 cost<Manufacture-2 cost<Manufacture-3 cost Hence, in the fourth embodiment, the T-shape forming member can be manufactured at low price.

MODIFICATION

In the above-mentioned first and third embodiments, the pole piece main body 1*a* being the component of the yoke 1 is formed into the cylindrical shape or the hollow cylindrical column shape. In the above-mentioned second and fourth embodiments, the pole piece main body 1*a* is formed into the cylindrical column shape. However, they are not limited. In the present invention, the pole piece main body 1*a* may be formed into the cylindrical column shape in the first and third embodiments, and the pole piece main body 1*a* may be formed into the cylindrical shape or the hollow cylindrical column shape in the second and fourth embodiments.

Additionally, in the present invention, the T-shaped pole piece is formed by combining the two parts, i.e., the pole piece main body 1*a* and the T-shape forming member. Thus, within a range of contents of the present invention, the shapes of the pole piece main body 1*a* and the T-shape forming member can be freely deformed, respectively. Therefore, the shape of the T-shaped pole piece can be designed more freely, as compared with the above comparative example.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-259309 filed on Sep. 7, 2005 including the specification, claims, drawings and summary is incorporated herein by reference in its entirety.

What is claimed is:

1. A magnetic circuit for a speaker device, the magnetic circuit comprising a pole piece and a magnetic gap, wherein the pole piece includes, a pole piece main body having a hollow column shape with an internal diameter of a first value and an outer diameter of a second value larger than the first value, and a T-shape forming member on the pole piece main body and having an outer diameter of a third value larger than the second value, and wherein the T-shape forming member includes, an annular part of annular shape having an internal diameter of the first value and an outer diameter of the third value, and a cylindrical part of cylindrical shape having an internal diameter of substantially the second value so that the cylindrical part is able to fit onto the pole piece main body, and an outer diameter of the third value.

2. The magnetic circuit for the speaker device according to claim 1, wherein the cylindrical part engages with an upper end part of the pole piece main body.

3. The magnetic circuit for the speaker device according to claim 1, further comprising a flange part provided on an outer side of the pole piece main body and a magnet arranged on the flange part and a plate arranged on the magnet, wherein the magnetic gap is defined by a distance between the plate and the outer diameter of the cylindrical part of the T-shape forming member.

4. The magnetic circuit for the speaker device according to claim 3, wherein the T-shape forming member is formed thicker than a thickness of the plate, and wherein a distance from a center line passing through a center in a direction of the thickness of the plate to an upper surface of the pole piece main body and a distance from the center line to a lower surface of the pole piece main body are set to a substantially same value.

5. A speaker device comprising a magnetic circuit including a pole piece and a magnetic gap, wherein the pole piece includes, a pole piece main body formed into a hollow column shape having an internal diameter of a first value and an outer diameter of a second value larger than the first value, and a T-shape forming member on the pole piece main body and having an outer diameter of a third value larger than the second value, and wherein the T-shape forming member includes, an annular part of annular shape having an internal diameter of the first value and an outer diameter of the third value, and a cylindrical part of cylindrical shape having an internal diameter of substantially the second value so that the cylindrical part is able to fit onto the pole piece main body, and an outer diameter of the third value.

* * * * *